United States Patent [19]

McCalmont et al.

[11] 4,276,652

[45] Jun. 30, 1981

[54] SECURE COMMUNICATION SYSTEM WITH IMPROVED FREQUENCY-HOPPING ARRANGEMENT

[75] Inventors: Arnold M. McCalmont, Acton; Matthew W. Slate, Sudbury, both of Mass.

[73] Assignee: Technical Communications Corp., Concord, Mass.

[21] Appl. No.: 947,475

[22] Filed: Oct. 2, 1978

[51] Int. Cl.[3] ..... H04K 1/04

[52] U.S. Cl. ..... 455/29; 375/2.1; 179/1.5 R; 179/1.5 FS

[58] Field of Search ..... 325/32–35, 325/65, 153; 179/1.5 R, 1.5 FS; 455/29; 375/1

[56] References Cited

U.S. PATENT DOCUMENTS

| | | | |
|---|---|---|---|
| 3,155,908 | 11/1964 | Berman | 179/1.5 R |
| 3,584,303 | 6/1971 | Guanella | 325/35 |
| 3,706,928 | 12/1972 | Beck | 325/33 |
| 3,824,468 | 7/1974 | Zegers et al. | 179/1.5 FS |
| 3,838,342 | 9/1974 | Bjorkman | 325/45 |
| 4,023,103 | 5/1977 | Malm | 325/63 |
| 4,037,159 | 7/1977 | Martin | 325/30 |
| 4,058,677 | 11/1977 | Maitland et al. | 179/1.5 FS |
| 4,066,964 | 1/1978 | Costanza et al. | 325/32 |

FOREIGN PATENT DOCUMENTS

| | | | |
|---|---|---|---|
| 2362567 | 4/1978 | France | 325/35 |

*Primary Examiner*—Howard A. Birmiel
*Attorney, Agent, or Firm*—Cesari & McKenna

[57] ABSTRACT

A signal scrambling system of the type in which the frequencies of the information signal band are inverted by heterodyning the information signal with a varying beat frequency. In accordance with the invention the beat frequency varies in a sequence of small increments which, in their totality, provide large overall frequency excursions and which, individually, are sufficiently small to avoid the generation of unduly strong spurious signals within the information signal band.

13 Claims, 3 Drawing Figures

SECURE COMMUNICATION SYSTEM WITH IMPROVED FREQUENCY-HOPPING ARRANGEMENT

BACKGROUND OF THE INVENTION

This invention relates to a voice privacy system. More particularly it relates to a secure system for the electronic transmission of speech and other analog signals. The system incorporates a frequency shift arrangement in which the input signals are shifted up and down in frequency in series of small steps in accordance with a pseudo-random sequence. It thus accomplishes large overall frequency shifts without the unduly spurious signals that result from single-step shifts of the same magnitude.

The invention is directed primarily to the prevention of eavesdropping on voice transmissions. To prevent the unauthorized reception of voice transmissions the signals are often scrambled at the transmitting end and unscrambled or reconstituted at the receiving end, which is provided with the appropriate "key" for this decoding process. Unauthorized listeners, on the other hand, do not have the key and, therefore, ideally they are unable to unscramble the transmission.

In practice of course, all scrambled transmissions can be unscrambled by unauthorized recipients, given sufficient time and equipment sophistication, the amount of time and the degree of equipment complexity depending on the complexity of the scrambling. For voice transmissions of the type with which we are primarily concerned, security is required for at most a few hours after transmission and the information being communicated is generally not so valuable as to cause an eavesdropper to spend large sums of money in code-breaking equipment. Therefore, simple scrambling techniques can be used, resulting in a relatively low cost for the scrambling and unscrambling circuitry.

One of these simple scrambling techniques is the use of frequency inversion combined with variable frequency shifting. The voice signal is heterodyned with the output of a beat frequency generator whose frequency is just above the voice band. The upper sideband of the resulting signal is filtered out, leaving the lower sideband, which is in the voice band and has the original voice signal, but with an inversion of the frequencies thereof.

To lend further complexity to the scrambling, the beat frequency is shifted up and down according to a prearranged program and the same program is used at the receiving end to reconstitute the voice signals. An unauthorized recipient must be able to follow these shifts in the beat frequency in order to unscramble the signal. For the system to work effectively, the shifts in frequency must be fairly substantial, for example 1500 hz with a nominal beat frequency of 3000 hz. Moreover they must occur rapidly enough so that they cannot be followed manually by means of a tuning knob operated by an eavesdropper. In prior systems the resulting abrupt, large-magnitude changes in the beat frequency have resulted in the generation of spurious signals which unduly degrade the information-bearing (voice) signals. The present invention is directed to the correction of this deficiency of prior beat-frequency-shifting systems.

SUMMARY OF THE INVENTION

More particularly it is the principal object of the present invention to provide a secure beat-frequency-shifting scrambling technique that does not unduly degrade the information bearing signals.

A more specific object of the invention is to provide a beat-frequency-shifting system that is characterized also by improved security against unauthorized unscrambling of the signals.

A beat frequency-shifting scrambler incorporating the invention shifts the beat frequency in small increments which, in their cumulative effect, provide substantial frequency excursions at a relatively rapid rate. Yet, because the individual steps are sufficiently small, the spurious signals arising therefrom are negligible in amplitude and therefore do not appreciably degrade the information bearing signals. Moreover, reduction in amplitude of the spurious signals makes eavesdropping even more difficult, since unscrambling techniques require knowledge of when the frequency changes are occurring and the spurious signals generated by large frequency shifts have been tell-tale indications of such changes.

DESCRIPTION OF THE PREFERRED EMBODIMENT OF THE INVENTION

Figure 1:
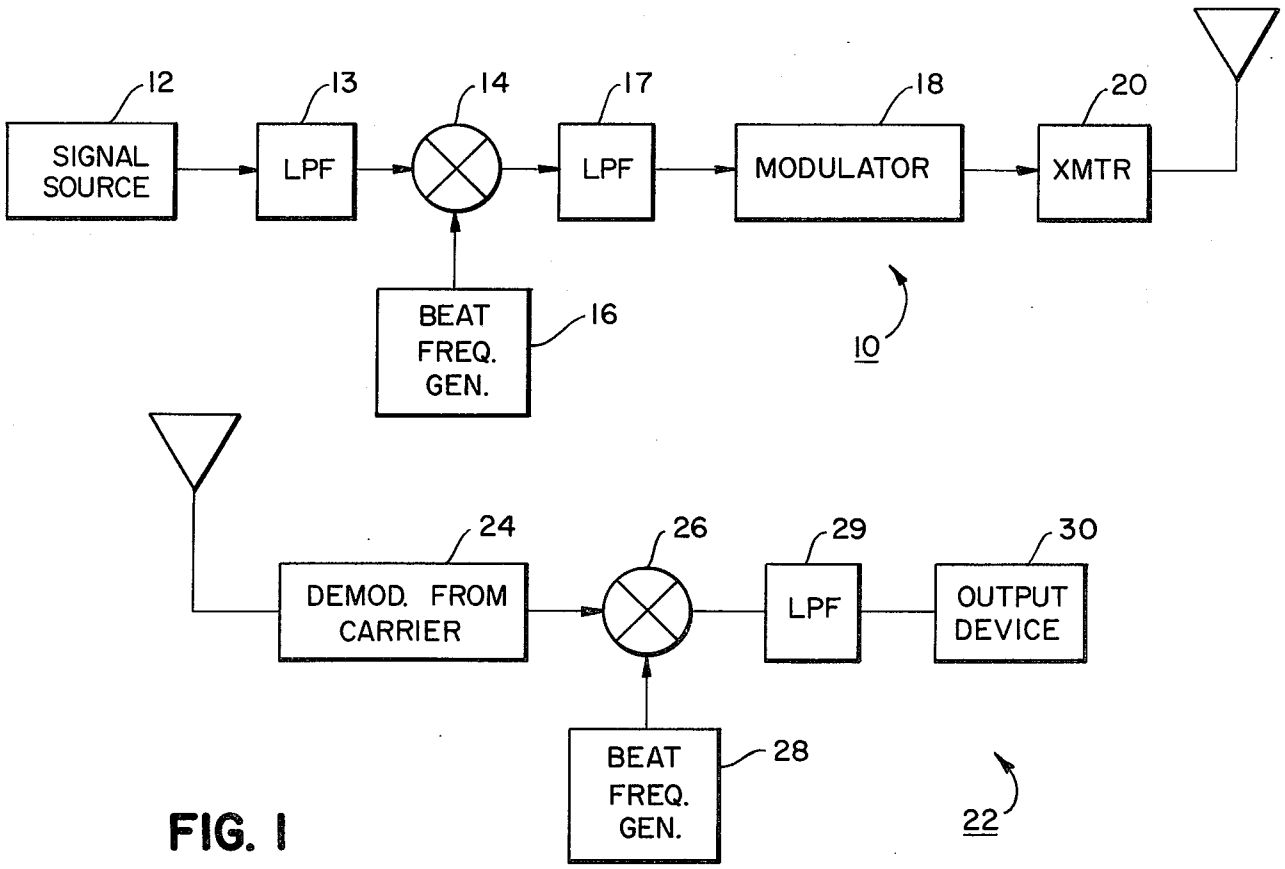
FIG. 1 is a block diagram of a communications system incorporating the invention.

In FIG. 1 we have illustrated a communications system of the type to which the present invention is directed. A transmitting station, generally indicated at 10, includes a signal source 12 which may, for example, comprise a microphone and associated amplifying and filtering circuitry. The output of the source 12 is passed through a low-pass filter 13 and then applied to a modulator 14, in which it modulates the output of a beat frequency generator 16. After passage through a low-pass filter 17, the resulting frequency-inverted voice signal is applied to a modulator 18 that modulates the output of a radio-frequency transmitter 20.

The low-pass filter 13 ensures that all signal components reaching the modulator 14 will be at frequencies below the lowest frequency of the generator 16. The filter 13 thus need not be included if the source 12 itself has a correspondingly limited frequency range. Similarly, the low-pass filter 17, which removes the upper sideband from the output of the modulator 14, can be omitted if the transmission channel is sufficiently limited in bandwidth to provide this function.

A receiving station 22 comprises a demodulator 24 that demodulates the inverted voice signal from the RF carrier. The output of the demodulator 24 is passed through low-pass filter 25 and, in turn, is applied to a demodulator 26 along with the output of a beat frequency generator 28, thereby to re-invert the voice-band frequencies. The resulting signal is passed through a low-pass filter 29, which removes the upper sideband from the output of the demodulator 26. The output of the output of the filter 29 is thus a replica of the output of the signal source 12. This signal is applied to an output device 30 which, in the case of a voice transmission, may include suitable amplifying and filtering circuits and a loud speaker. The output device 30 may also provide the function of the low-pass filter 29.

To provide privacy for communications between the transmitting station 10 and receiving station 22, the frequency of the beat frequency generator 16 is varied according to a pre-arranged pattern so that the voice signal cannot be recovered unless one uses a beat frequency generator whose frequency follows the same pattern. The beat-frequency generator 28 at the receiving station 22 includes circuitry that provides this pattern.

On the other hand unauthorized recipients of the RF signals transmitted from station 10 do not know the beat frequency pattern and are therefore unable to recover the voice signal. As stated above, the present invention relates to an improved beat frequency generator whose frequency changes in small, irregular steps, thus awarding undue degradation of the voice signals.

Figure 2:
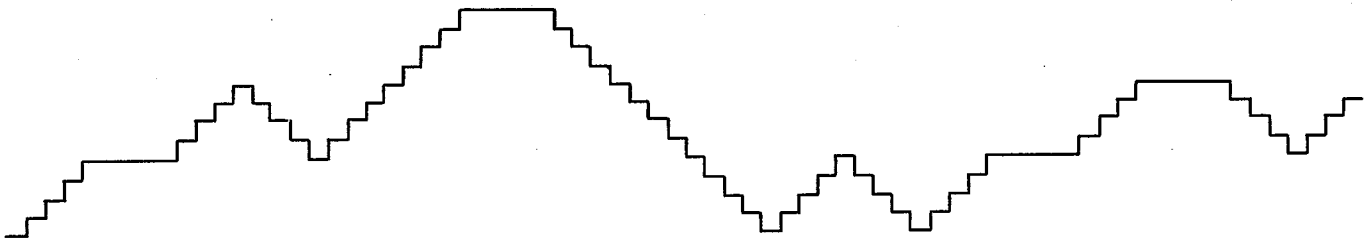
FIG. 2 is a graph illustrating beat-frequency changes as a function of time in a system incorporating the invention.

In FIG. 2 we have illustrated a fragment of a typical pattern generated by the beat frequency generators 16 and 18. The beat frequency is varied from a minimum of 1500 Hz to a maximum of 4500 Hz. In contrast with prior systems in which the system is abruptly changed from one extreme to the other, the frequency is varied in relatively small, irregular increments of 5 to 75 Hz. These frequency steps last for one to ten milliseconds, with a full range frequency excursion requiring a minimum of about 100 milliseconds. The frequency variations follow a pseudorandom pattern in which the frequency may move either up or down in any given step interval, or it may dwell for irregular time intervals at the same value. The relatively small frequency increments result in minimal spurious signal power, so that the quality of the voice signals is essentially unaffected by the frequency changes.

Figure 3:
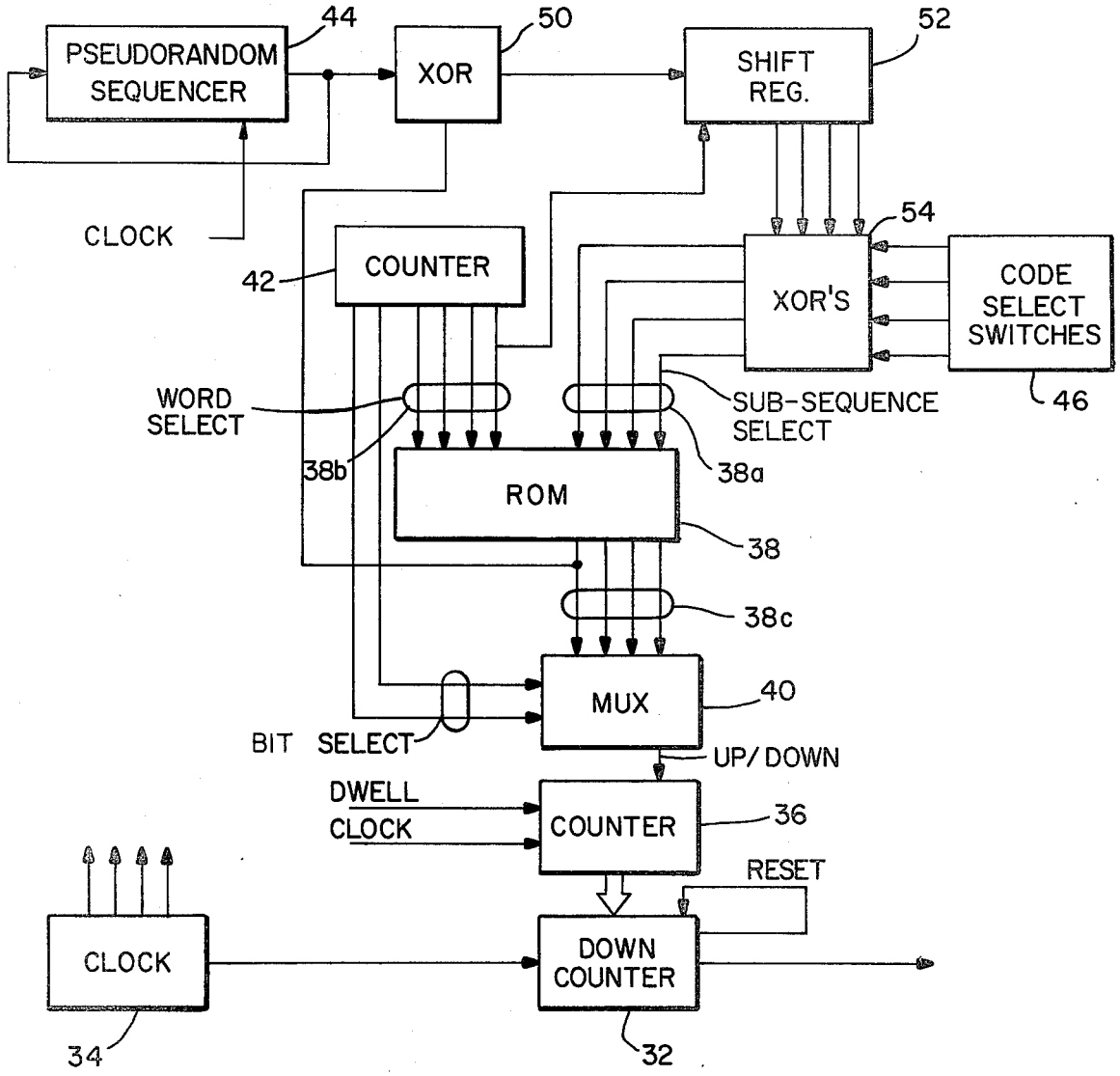
FIG. 3 is a schematic diagram, in block form, of a beat frequency generator used in the system of FIG. 1.

FIG. 3 illustrates the preferred construction used for the beat frequency generators 16 and 28 in FIG. 1. The output of each generator is provided by a frequency divider 32 which divides the frequency of the output of a stable clock 34 having a frequency $f_o$. Specifically, the frequency divider 32 includes a counter 32*a* which is loaded with a number N, contained in a counter 36, following which it counts downward in response to the pulses from the clock 34. When it reaches zero, it resets by again loading in the number N and then it counts down again. The stage in the counter 32*a* containing the second most significant bit thus alternates between the ZERO and ONE states at the frequency $f_o/N$. The divider 32 also includes a flip-flop (not shown) that is toggled by the output of that stage and the square-wave output of this flip-flop, at the frequency $f_o/2N$, is the beat frequency signal. The contents of the counter 36 are changed from time to time in a manner presently to be described, thereby changing the factor N and effecting a corresponding change in the beat frequency.

Signals derived from the clock 34 are used to time the operations of various other elements in the beat frequency generator. These timing signals are obtained in a conventional manner by means of frequency counters (not shown) included in the clock. As an example, when the system is used for the transmission of voice signals, the clock 34 may have a basic frequency of 500 kHz which, when divided by factors ranging from 140 to 250 in the divider 32, provides an approximate beat frequency range of 2 kHz to 3.5 kHz.

In the present example, the counter 36 counts clock pulses having a rate of 250 Hz so that the count contained therein changes every four milliseconds, except when the counter is inhibited by a dwell signal as described below. Thus, the number by which the frequency divider 32 divides the basic clock frequency changes at intervals of 4 milliseconds as does the resulting beat frequency supplied by the generator.

The counting by the counter 36 is controlled in part by an up/down signal provided by a read-only memory 38 by way of a multiplexer 40. Specifically the memory 38 in the present example contains 16 pseudorandom counting sub-sequences, each of these sub-sequences consisting of 16 four-bit words. Each sub-sequence is selected, in a manner to be described, by signals applied to a set of four sub-sequence address conductors 38*a*. A word address counter 42, in turn, counts clock pulses and applies the four most significant bits of the resulting count to a set of word address conductors 38*b*. The signals on these conductors cause the memory 38 to read out in order all the words of each selected sub-sequence.

The four bits of each word are transmitted in parallel by the memory 38 over a set of output conductors 38*c*. In response to the two least significant bits in the counter 42, the multiplexer 40 then selects the individual bits in the word by connecting the output conductors 38*c*, one at a time, to an up/down control terminal 36*a* of the counter 36. If the signal on a conductor 38*c* corresponds to a binary ONE, for example, it causes the counter 36 to count up and, conversely, if it corresponds to a binary ZERO, it causes the counter 36 to count down. The timing is arranged so that with the counter 36 counting pulses having a 250 Hz rate, i.e., changing its count every four milliseconds, the counter 42 is pulsed every 16 milliseconds and the multiplexer 40 thus switches from one of the conductors 38*c* to the next at the same rate. The counter 36 will count up four counts or down four counts during the time that each of the conductors 36*c* is connected through to the up/-down input terminal of the counter. Moreover, with each of the conductors 38*c* being connected through for an interval of 16 milliseconds, the entire word appearing on the conductors 36*c* is applied to the counter 36 over an interval of 64 milliseconds. The counter 42 correspondingly changes the word-selection signal on the conductors 38*b* once every 64 milliseconds to select the next word in the selected sub-sequence.

The sub-sequences in the memory 38 are selected in an order determined by (1) the binary sequence generated by a pseudorandom sequencer 44 and (2) a set of code-select switches 46. The sequence generated by the sequencer 44 depends, as is well known, on feedback paths within the sequencer and on the stage from which the output is taken. Each or both of these can be either permanently wired in or be made manually variable by means of switches (not shown). The starting point of the generated sequence, i.e., the initial state of the sequencer, can also be controlled by means of external inputs. The sequencer 44 receives a steady succussion of clock pulses and thus operates continuously. With the illustrative timing arrangement described above, these pulses will occur once every 1024 milliseconds.

The output of the sequencer 44 is passed serially through an exclusive OR gate 50 to a shift register 52. In the present example, the shift register 52 has four stages, the contents of which are applied to a set of four exclusive OR gates 54. The other inputs of the gates 54 are provided by the four code-select switches 46.

The manner in which the sub-sequences are selected is as follows. Assume that initially the sequencer 44 has been set to a preselected starting state, the register 52 and the counter 42 have been cleared and the operator has manually set the code select switches 46 according to a prearranged pattern. The outputs of the exclusive OR gates 54 will then select the first sub-sequence to be retrieved from the read-only memory 38. The outputs of the counter 42 will then select, in order, the words within that sub-sequence, a new word being selected every 64 milliseconds in the present example. The counter 42 then completes a counting cycle, causing all the words from the selected sub-sequence to be retrieved from the memory 38.

The selected sub-sequence is thus applied bit-by-bit to the up/down control terminal on the counter 36 to control the counting sequence in that counter and thereby control the variations in the beat frequency output from the counter 32.

The next transition in the conductor **38*b* that carries the most significant bit of the counter content then serves as a clock signal for the shift register 52. The contents of the register 52 shift one bit to the right and the next bit in the output of the sequencer 44, as modified by the exclusive OR circuit 50, is loaded into the shift register 52. The other input for the exclusive OR circuit 50 is provided by one of the output conductors 38*c* of the memory 38. Thus, if the signal on that conductor has the same binary value as the bit from the sequencer 44, the shift register 52 receives a binary ZERO from the exclusive circuit 50. Conversely, if the signals applied to the exclusive OR circuit 50 correspond to different binary values, the shift register 52 receives a binary ONE. The exclusive OR circuits 54 then logically combine the new four-bit word contained in the shift register 52 with the outputs of the code-select switches 46 to provide a new sequence selection on the conductors 38*a***.

The new sub-sequence is then retrieved and used in controlling beat frequency variations.

As noted above, the system also preferably includes a dwell arrangement whereby the beat frequency may remain constant for intervals whose timing and duration vary on a pseudorandom basis. Specifically, whenever the output of the exclusive OR circuit 50 is a binary ONE, this signal, as applied to the counters 36 and 42, inhibits the operation of both counters. Thus, the counters retain their counts and the beat frequency remains constant. The dwell will last for at least the duration of the word then appearing on the conductors **38*c*, i.e., for 64 milliseconds in the present example, and it will be repeated when the next clock pulse arrives at the pseudorandom sequencer 44, if the sequencer output does not change, causing the output of the exclusive OR circuit 50** to remain a binary ONE.

In the circuit described above, the shift register 52, gates 54, switches 46, memory 38 and the feedback through the exclusive OR circuit 50 operate as a non-linear code generator having a relatively short sequence corresponding to the number of stages in the register 52. The pseudorandom generator 44, which is a linear generator, functions to greatly lengthen the non-linear pseudorandom sequence. The dwell arrangement also contributes to the length of the sequence. These factors render very difficult the unauthorized decoding of messages transmitted by means of the system, since the sequence does not repeat for many hours, much longer than any conceivable voice transmission. Unauthorized decoding is is also hindered by the large number of sequences obtainable with components of relatively small capacity. For example, a thirty-one-stage pseudorandom generator 44 can, in combination with the four code-select switches 46, provide over a million possible pseudorandom beat frequency patterns. The switches 46 permit a rapid change among 16 possible sequences by prearrangement between the operators of the sending and receiving stations.

While the example described herein uses the beat frequency increments of 8 Hz to 25 Hz, spaced by intervals that are four milliseconds or multiples thereof, the advantages of the invention can be realized over a range of frequency-shift increments. For example, in a voice transmission system using frequency inversion, the beat frequency increments may suitably range from 5 Hz to 75 Hz.

Over this range the spurious signal power in the voice band is sufficiently low to avoid undue interference with the voice signals. Moreover, since these spurious signals are tell-tale indications of the timing of beat-frequency changes, their reduction increases the difficulty of unauthorized reception of the scrambled transmissions The present scrambling system can be combined with other encoding techniques to add further complexity in the encoded signal and thereby make unauthorized decoding even more difficult. In particular, we have combined the present arrangement with a band splitting technique in which one part of the voice band is time-shifted relative to another part. A system of this type is disclosed in the co-pending application of Arnold M. McCalmont, Ser. No. 866,244, filed Jan. 3, 1978, for Voice Privacy System With Amplitude Masking.

What is claimed as new and desired to be secured by Letters Patent of the United States is:

1. In a secure communications system of the type in which information bearing signals are scrambled by repeatedly shifting their frequency spectrum in excursions up or down within a range extending from a lower frequency limit to an upper frequency limit in a predetermined manner in accordance with the output of a variable beat frequency generator, the improvement in which the variable frequency generator comprises means for varying said beat frequency (a) in increments that are small compared with substantially all of the frequency excursions, and (b) with the durations of the increments varying on a pseudo-random basis.

2. A system as defined in claim 1 in which (a) said information-bearing signals are voice signals, (b) said increments are in the range of 5 Hz to 75 Hz.

3. The system defined in claim 1 is which the variable frequency generator comprises:

A. a storage unit containing a plurality of sequences of digits,

B. a pseudorandom sequence generator that generates an input code sequence,

C. means for retrieving sub-sequences from said storage unit in an order determined by a retrieval code, D. code generating means for generating the retrieval code by modifying the input code sequence in accordance with part of each sub-sequence retrieved from said storage unit, and E. A clock, F. a clock output means receiving the frequency of said clock and providing said variable frequency output by modifying said received clock frequency in accordance with the sub-sequences retrieved from said storage unit.

4. The system defined in claim 3 including dwell means for inhibiting changes in said variable frequency in response to a logical combination of said input code sequence and a number retrieved from said storage unit.

5. The system defined in claim 4 in which said dwell means responds to successive digits in the output of said code generating means.

6. The system defined in claim 3:

A. in which said register means includes a shift register that shifts in response to a shift signal and thereby provides as an output the individual digits of said code word, B. said code generating means generates said retrieval code in response to a match or lack thereof between successive output digits of said shift register and digits in the sequences retrieved from said storage unit.

7. The system defined in claim 3:

A. in which each sequence contains a plurality of words, each word containing a plurality of digits, B. including a word counter for counting the words in each sequence, and C. in which said storage unit is connected to be addressed by an addressed designation comprising:

(i) serving as a sequence identifier, and (ii) serving as a word identifier.

8. The system defined in claim 6:

A. in which each sequence contains a plurality of words, each word containing a plurality of digits, B. including a word counter for counting the words in each sequence, and C. in which said storage unit is connected to be addressed by an addressed designation comprising:

(i) serving as a sequence identifier, and (ii) serving as a word identifier.

9. A system defined in claim 8:

A. including a second shift register, (i) connected to shift in response to said shift signal, and (ii) connected to receive serially the output of said code generating means, B. in which the contents of said second shift register identify the sequence being retrieved from said storgage unit, and C. in which said second shift register is connected to apply to said storage unit, the part of the address designation consisting of the sequence identifier.

10. A system defined in claim 9 in which said shift signal including means for deriving said shift signal from the output of said counter in response to completion of a counting cycle thereof.

11. The system defined in claim 3 in which said frequency changing means includes:

A. an up/down sequence counter connected to (i) one count a succession of periodic signals, (ii) count up one successive digits retrieved from storage unit have a first value and three count down when said retrieved digits have a second value, and B. a frequency counter connected to a. counter signals from said clock, and b. provide an output signal each time it has counted a number of clock signals equal to the contents of said sequence counter.

12. The system defined in claim 11 in which the frequency of said clock and the frequency of said periodic signals are such that the increments of said frequency counter output is sufficiently small to generate inaudible sperious signal in the frequency spectrum of said information bearing signal.

13. The system defined in claim 7 in which said frequency changing means includes:

A. an up/down sequence counter connected to (i) one count a succession of periodic signals, (ii) count up one successive digits retrieved from storage unit have a first value and three count down when said retrieved digits have a second value, and B. a frequency counter connected to a. counter signals from said clock, and b. provide an output signal each time it has counted a number of clock signals equal to the contents of said sequence counter.

* * * * *